US007371197B1

(12) United States Patent
Yu

(10) Patent No.: US 7,371,197 B1
(45) Date of Patent: May 13, 2008

(54) SAFETY RACKET

(75) Inventor: Kuo-Pin Yu, Taichung (TW)

(73) Assignee: Yuan Min An Enterprise Co., Ltd., Taichung (TW)

( * ) Notice: Subject to any disclaimer, the term of this patent is extended or adjusted under 35 U.S.C. 154(b) by 0 days.

(21) Appl. No.: 11/753,733

(22) Filed: May 25, 2007

(51) Int. Cl.
*A63B 49/02* (2006.01)
*A63B 51/00* (2006.01)

(52) U.S. Cl. ..... 473/539; 473/540; 473/543; 473/521; 473/522

(58) Field of Classification Search ..... 473/520–522, 473/524, 539, 540, 543
See application file for complete search history.

(56) References Cited

U.S. PATENT DOCUMENTS 3,664,669 A * 5/1972 Latham et al. ..... 473/541
4,005,862 A * 2/1977 Portz et al. ..... 473/541
4,333,649 A * 6/1982 Vaughn et al. ..... 473/540
4,949,968 A * 8/1990 Korte-Jungermann ..... 473/539
5,310,180 A * 5/1994 Wu ..... 473/523
5,879,248 A * 3/1999 Marsico ..... 473/534
6,440,015 B1 * 8/2002 Chang ..... 473/540
7,309,299 B2 * 12/2007 Pezzato et al. ..... 473/540
2007/0123376 A1 * 5/2007 Gazzara et al. ..... 473/524
2007/0123377 A1 * 5/2007 Gazzara et al. ..... 473/540
2007/0135245 A1 * 6/2007 Gazzara et al. ..... 473/524
2007/0238560 A1 * 10/2007 Gazzara et al. ..... 473/516

* cited by examiner

*Primary Examiner*—Raleigh W. Chiu
(74) *Attorney, Agent, or Firm*—Browdy and Neimark

(57) ABSTRACT

A safety racket includes a head frame, a handle, a connecting portion, several nail members and a string. The head frame has a plurality of through holes. The connecting portion connects between the head frame and the handle. The nail members each have a head and at least one body extending along an axial direction from the head and inserted into the through hole. The body of the nail member has a distal end protruding from the through hole, and a lateral hole positioned at the distal end and extending along a direction substantially perpendicular to the axial direction. The string passes through the lateral hole and interweaved to form a net surface. Since the string is not exposed outside the head frame, the string is well protected to avoid damaging by external objects. The racket also has excellent shock-absorbing effect due to elastic material, such as rubber and plastic, adopted by the nail members.

5 Claims, 7 Drawing Sheets

SAFETY RACKET

BACKGROUND OF THE INVENTION

1. Field of the Invention

The present invention relates to sports goods and more particularly, to a safety racket, which has excellent shock-absorbing effect and the string of the safety racket is protected from external objects.

2. Description of the Related Art

A conventional racket has a head frame, a handle and a connecting portion connected the head frame and the handle. The head frame has a plurality of through holes for passing by a string. During installation, the string is passed through one of the through holes outward, then bent around the outer periphery of the head frame, and then passed through another through hole inward. Part of the string is exposed outside the head frame such that the string is probably damaged or broken by external force. Besides, due to the string is stopped directly against the outer periphery of the head frame; the shock energy is transmitted from the string directly to the head frame and the handle when the racket hits the ball. The user receives a larger shock power when using the racket.

SUMMARY OF THE INVENTION

The present invention has been accomplished under the circumstances in view. It is one object of the present invention to provide a safety racket, which has excellent shock-absorbing effect.

It is another object of the present invention to provide a safety racket, which has a string not exposed outside the head frame to avoid damaging by external objects.

To achieve these and other objects of the present invention, the safety racket comprises a head frame provided with a plurality of through holes, a handle, a connecting portion connected between the head frame and the handle, at least one nail member and a string. The nail member has a head positioned at an outer end of the through hole, and at least one body extending along an axial direction from the head and inserted into the through hole. The body is provided with a distal end protruding from the through hole, and a lateral hole positioned at the distal end and extending along a direction perpendicular to the axial direction. The string passes through the lateral hole of the nail member and interweaved to form a net surface.

DETAILED DESCRIPTION OF THE INVENTION

Figure 1:
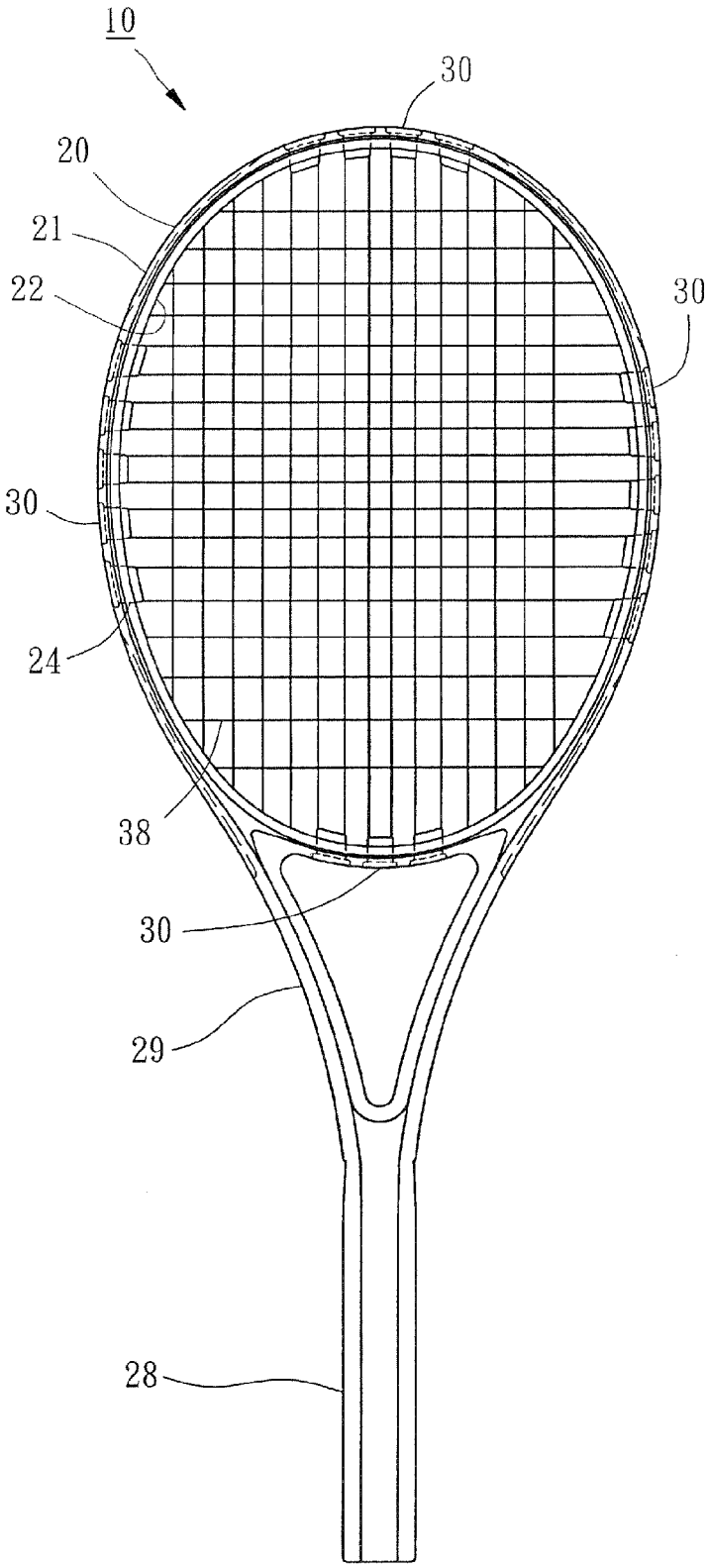
FIG. 1 is a front view of a first embodiment of the present invention.
Figure 2:
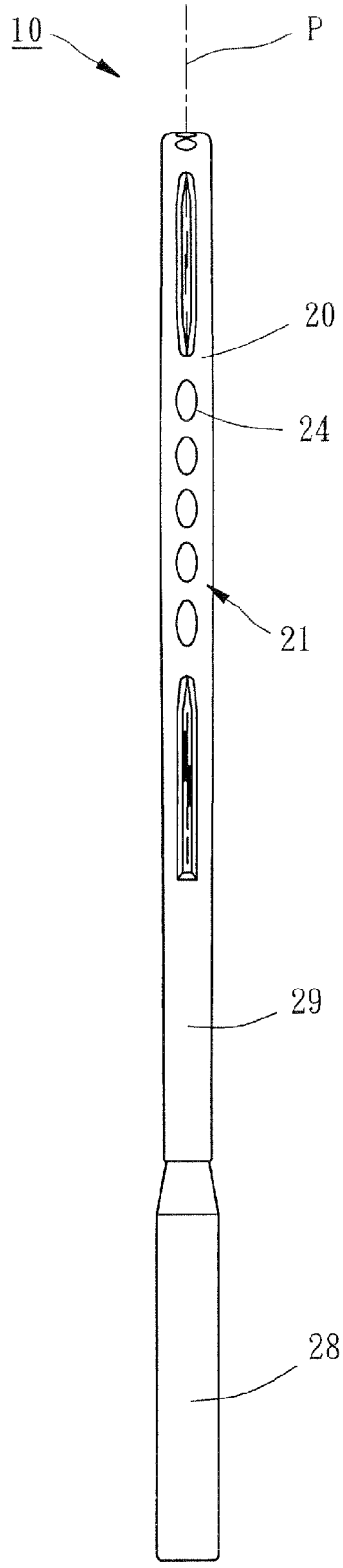
FIG. 2 is a side view of the first embodiment of the present invention.
Figure 3:
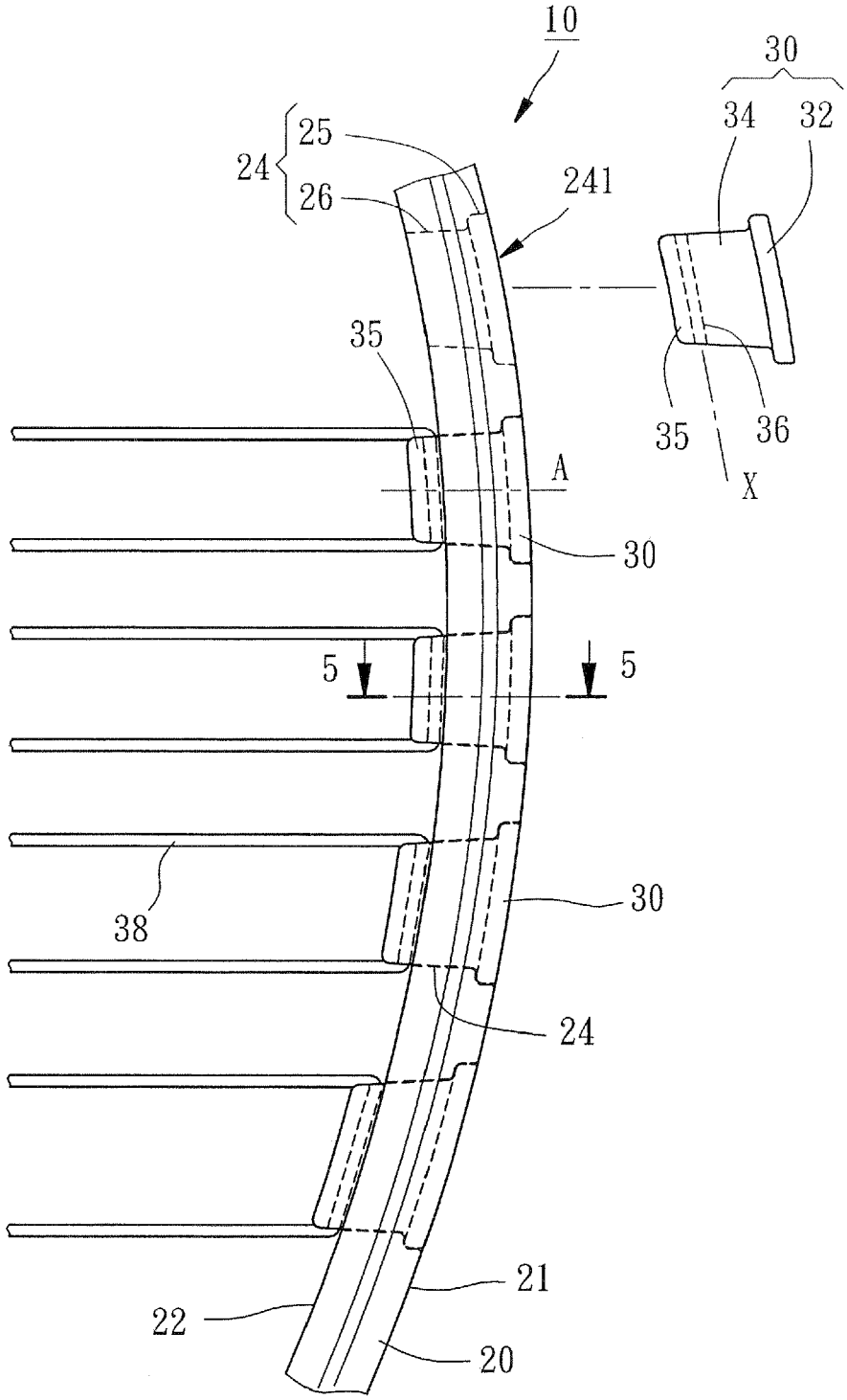
FIG. 3 is an exploded view of part of the first embodiment of the present invention.

Referring to FIGS. 1-3, a safety racket 10 in accordance with the first embodiment of the present invention is a tennis racket. The tennis racket is comprised of a head frame 20, a handle 28, a connecting portion 29, a plurality of nail member 30 and a string 38.

The head frame 20 has an outer surface 21, an inner surface 22 and a plurality of through holes 24 extended from the outer surface 21 to the inner surface 22. The through holes 24 each have a large diameter portion 25 and a small diameter portion 26. The width of each of the through holes 24 is about equal to the distance between two neighbor sections of the string 38, which is larger than the width of the through hole of the conventional racket.

The handle 28 is for gripping by the user. The connecting portion 29 connects between the head frame 20 and the handle 28 as usual racket.

Figure 4:
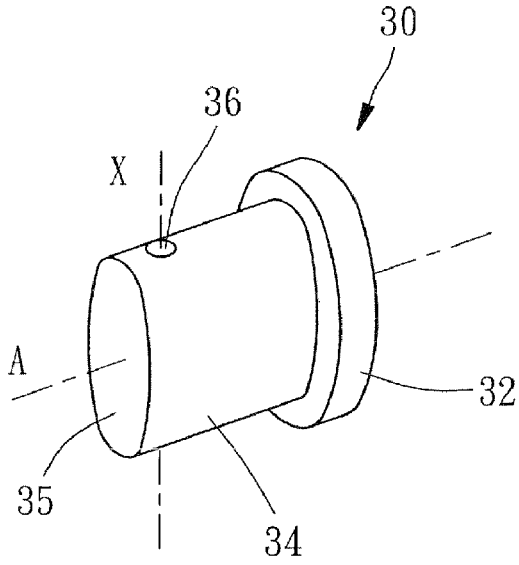
FIG. 4 is a perspective view of the nail member according to the first embodiment of the present invention.
Figure 5:
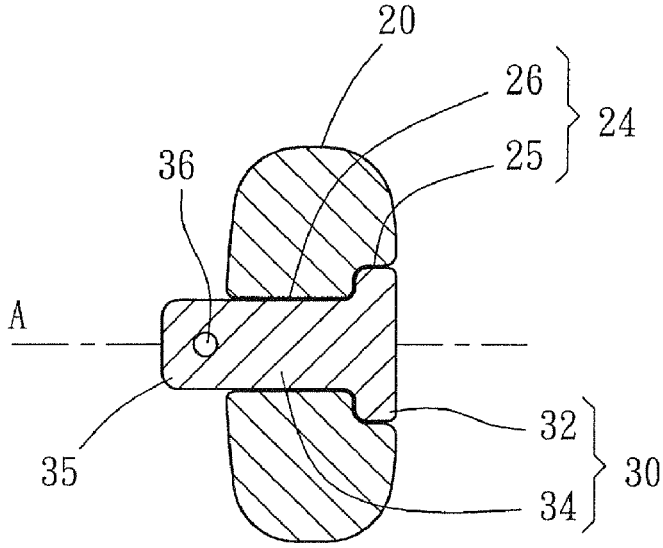
FIG. 5 is a sectional view along line 5-5 of FIG. 3.

As shown in FIGS. 4 and 5, the nail members 30 each have a head 32 positioned at an outer end 241 of the through hole 24, and a body 34 extending along an axial direction A from the head 32 and inserted into the through hole 24. The head 32 of the nail member 30 is received in the large diameter portion 25 of the through hole 24, and the body 34 of the nail member 30 is received in the small diameter portion 26 of the through hole 24. The body 34 of the nail member 30 is provided with a distal end 35 protruding from the through hole 24, and a lateral hole 36 positioned at the distal end 35 and extending along a direction X about perpendicular to the axial direction A.

The string 38 is passed through the lateral hole 36 of the nail member 30 and interweaved to form a net surface P. The nail member 30 and the head frame 20 are fastened together by tension of the string 38. The extending direction X of the lateral hole 36 of the nail member 30 is about parallel to the net surface P.

Since the string 38 doesn't touch the head frame 20 directly and the nail members 30 are made of shock-absorbing materials, such as nylon, plastic or fiber reinforced plastic, the vibration energy of the racket 10 generated by hitting ball can be absorbed efficiently. Furthermore, the string 38 is passed through the lateral hole 36 of the nail member 30 instead of went around the outer surface 21 of the head frame 20 as the conventional racket. It can be avoided that the string 38 is damaged or even broken by rubbing against ground surface, wall surface or other external object during weaving. Therefore the racket is safe in use and the lifetime of the string can be prolonged.

Figure 6:
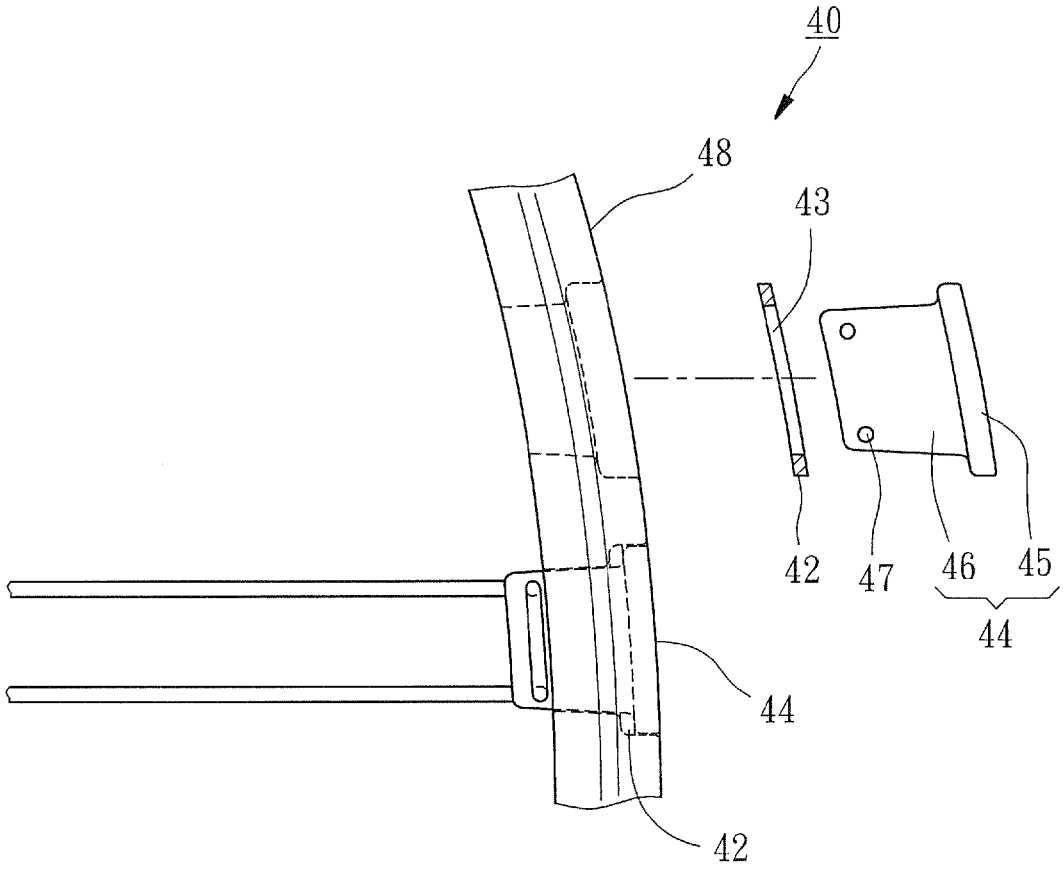
FIG. 6 is a schematic view of part of a second embodiment of the present invention.

Base on the spirit of the present invention, the mounting location and the number of the nail member can be altered according to user's need. In fact, the nail member 30 can be mounted at any location of the head frame 20. The shape of the nail member also has a lot of alternatives. As shown in FIG. 6, a safety racket 40 according to the second embodiment of the present invention further comprises a pad 42 disposed between the head 45 of the nail member 44 and the head frame 48. The pad 42 has a longitudinal hole 43 for receiving the body 46 of the nail member 44. The pad 42 is made of elastic material, such as rubber, PU, PVC or other plastic, to further absorb the vibration of the racket 40 when hitting ball. In this embodiment, the lateral hole 47 of the nail member 44 extends along a direction perpendicular to the net surface of the racket 40.

Figure 7:
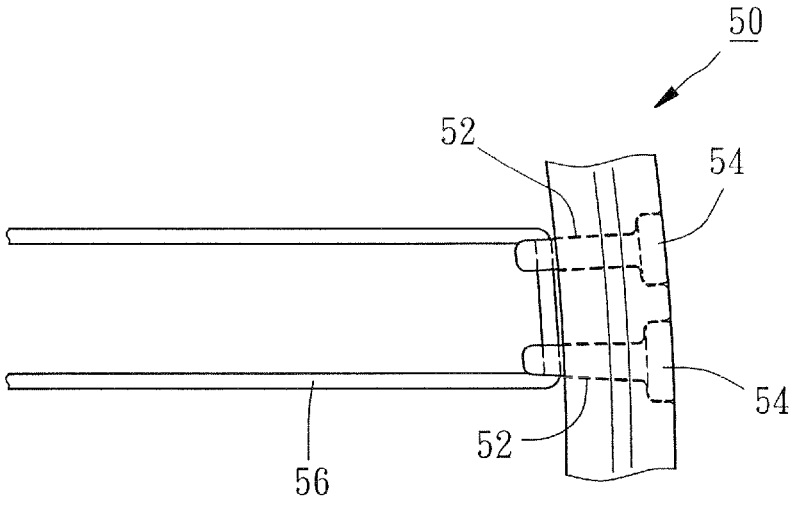
FIG. 7 is a front view of part of a third embodiment of the present invention.

As shown in FIG. 7, a safety racket 50 according to the third embodiment of the present invention has a plurality of through holes 52 and nail members 54 each have a width narrower than that of the safety racket of the first embodiment. The distance between the neighbor through holes 52 is about equal to the distance between the neighbor section of the string 56. The structure of this embodiment has the same effect as the first embodiment.

Figure 8:
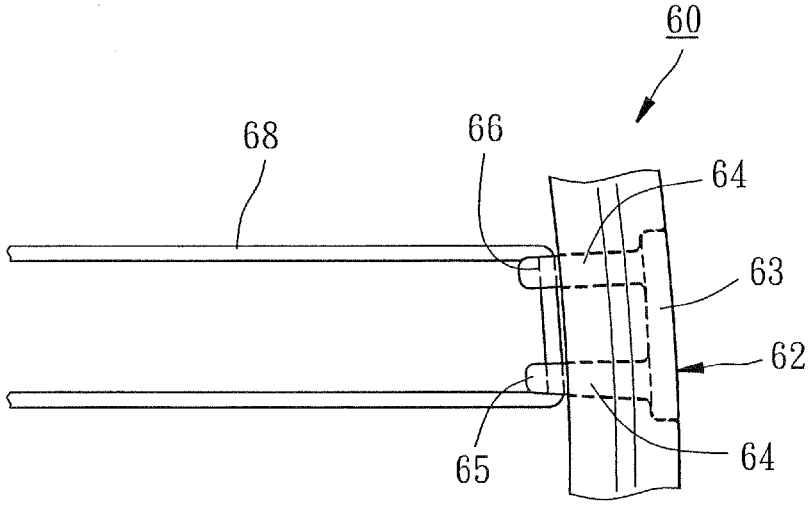
FIG. 8 is a front view of part of a fourth embodiment of the present invention.

As shown in FIG. 8, a safety racket 60 according to the fourth embodiment of the present invention is shown comprising a nail member 62 with a head 63 and two bodies 64. The distal ends 65 of the bodies 64 each are provided with a lateral hole 66 through which the string 68 is passed. Thus, the installation of the nail member 62 is more convenience than that of the third embodiment. Alternatively, the number of the nail member is not limited during actual manufacture.

Figure 9:
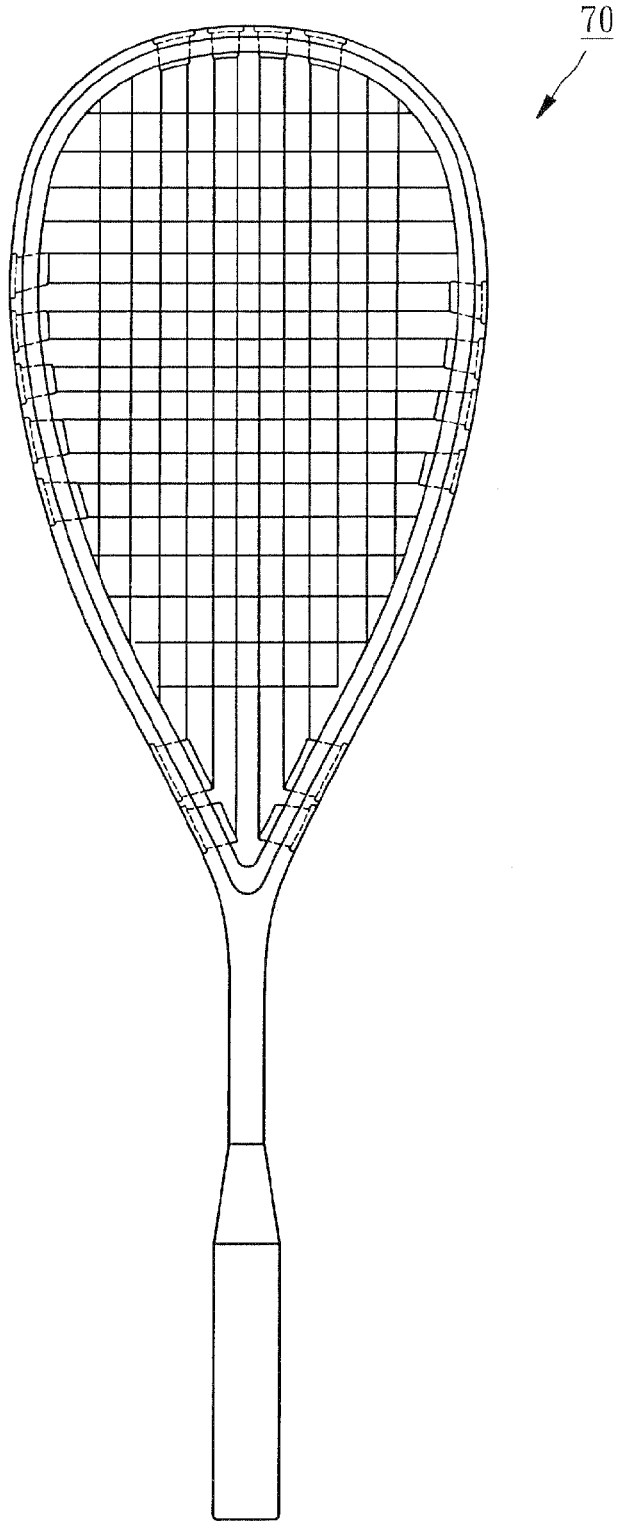
FIG. 9 is a front view of a fifth embodiment of the present invention.
Figure 10:
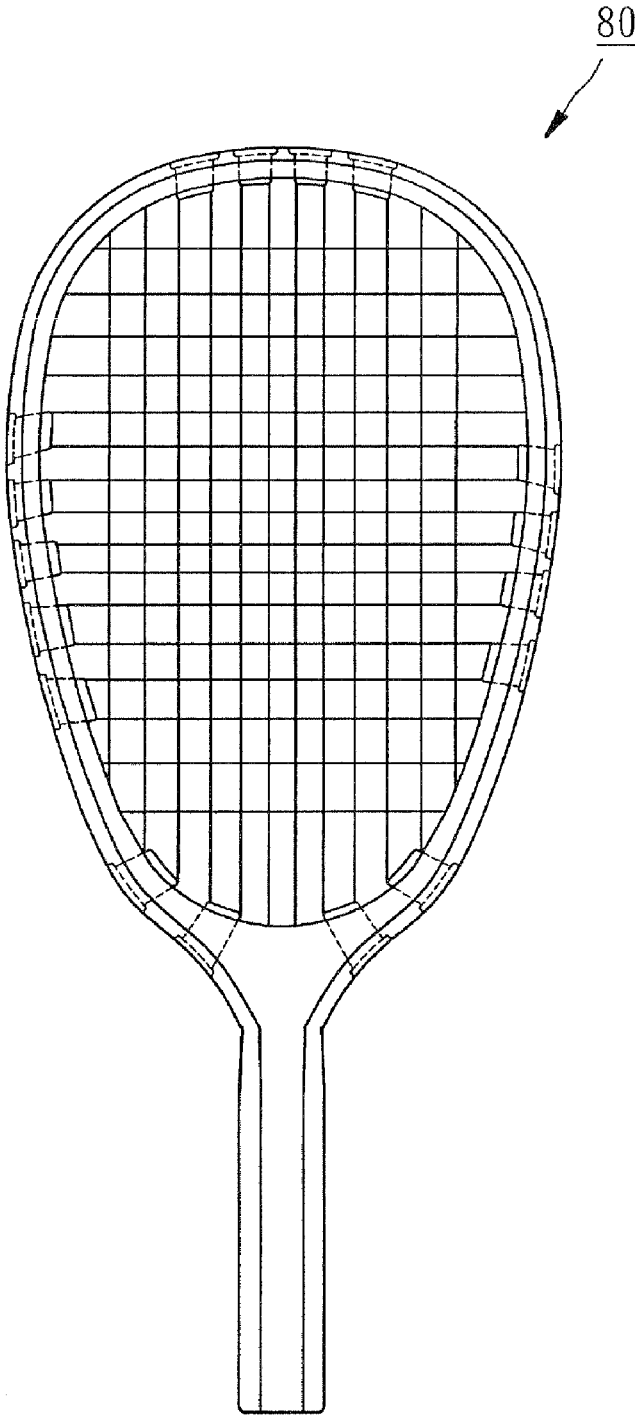
FIG. 10 is a front view of a sixth embodiment of the present invention.

Aforesaid safety rackets are embodied by tennis rackets. The spirit of the present invention applies to squash racket, badminton racket or other type of racket. As shown in FIG. 9, a safety racket 70 according to the fifth embodiment of the present invention is a squash racket. As shown in FIG. 10, a safety racket 80 according to the sixth embodiment of the present invention has another shape. In fact, the spirit of the present invention can be applied to any shape of racket.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A safety racket comprising:

a head frame provided with a plurality of through holes;

a handle;

a connecting portion connected between the head frame and the handle;

at least one nail member having a head positioned at an outer end of the through hole, and at least one body extending along an axial direction from the head and inserted into the through hole; wherein the body is provided with a distal end protruding from the through hole, and a lateral hole positioned at the distal end and extending along a direction substantially perpendicular to the axial direction; and a string passed through the lateral hole and interweaved to form a net surface.

2. The safety racket as claimed in claim 1, wherein the through holes of the head frame each have a large diameter portion positioned at one end thereof for receiving the head of the nail member, and a small diameter portion positioned at the other end thereof for receiving the body of the nail member.

3. The safety racket as claimed in claim 1, wherein the lateral hole extends along a direction substantially parallel to the net surface.

4. The safety racket as claimed in claim 1, wherein the lateral hole extends along a direction substantially perpendicular to the net surface.

5. The safety racket as claimed in claim 1 further comprises a pad disposed between the head of the nail member and the head frame and having a longitudinal hole for receiving the body of the nail member.

* * * * *